US007695582B2

(12) United States Patent
Stowell et al.

(10) Patent No.: US 7,695,582 B2
(45) Date of Patent: Apr. 13, 2010

(54) METHOD OF FORMING CERAMIC LAYER

(75) Inventors: William Randolph Stowell, Rising Sun, IN (US); Terry James Kent, Cincinnati, OH (US); Thomas Walter Rentz, Cincinnati, OH (US); Jane Ann Murphy, Franklin, OH (US); Daniel Peter Ivkovich, Fairfield, OH (US); Andrew Jay Skoog, West Chester, OH (US)

(73) Assignee: General Electric Company, Schenectady, NY (US)

( * ) Notice: Subject to any disclaimer, the term of this patent is extended or adjusted under 35 U.S.C. 154(b) by 732 days.

(21) Appl. No.: 11/116,291

(22) Filed: Apr. 28, 2005

(65) Prior Publication Data

US 2006/0243368 A1 Nov. 2, 2006

(51) Int. Cl.
*C03B 29/02* (2006.01)
*B32B 43/00* (2006.01)

(52) U.S. Cl. ..... 156/89.23; 156/89.11; 156/94

(58) Field of Classification Search ..... 156/89.11, 156/89.23, 94
See application file for complete search history.

(56) References Cited

U.S. PATENT DOCUMENTS

| | | | | |
|---|---|---|---|---|
| 4,376,004 | A | 3/1983 | Bratton et al. | |
| 4,563,329 | A | 1/1986 | Morishita et al. | |
| 4,596,692 | A | 6/1986 | Morishita et al. | |
| 4,596,746 | A | 6/1986 | Morishita et al. | |
| 4,605,461 | A * | 8/1986 | Ogi | 156/233 |
| 4,670,215 | A | 6/1987 | Morishita et al. | |
| 4,839,121 | A | 6/1989 | Collins, Jr. | |
| 4,851,188 | A | 7/1989 | Schaefer et al. | |
| 4,898,631 | A | 2/1990 | Collins, Jr. | |
| 5,254,413 | A | 10/1993 | Maricocchi | |
| 5,405,571 | A | 4/1995 | Truckner et al. | |
| 5,620,637 | A | 4/1997 | Kaga et al. | |
| 5,762,737 | A | 6/1998 | Bloink et al. | |
| 5,813,609 | A | 9/1998 | Ellerhorst | |
| 5,867,762 | A * | 2/1999 | Rafferty et al. | 428/548 |
| 6,165,600 | A | 12/2000 | Ivkovich, Jr. et al. | |
| 6,355,356 | B1 | 3/2002 | Hasz | |
| 6,451,454 | B1 | 9/2002 | Hasz et al. | |
| 6,465,090 | B1 | 10/2002 | Stowell et al. | |
| 6,467,534 | B1 | 10/2002 | Klug et al. | |
| 6,485,590 | B1 | 11/2002 | Ivkovich, Jr. et al. | |
| 6,505,673 | B1 | 1/2003 | Abuaf et al. | |
| 2003/0209534 | A1 * | 11/2003 | Ferguson | 219/548 |
| 2004/0124231 | A1 * | 7/2004 | Hasz et al. | 228/245 |
| 2005/0166397 | A1 * | 8/2005 | Ng | 29/889.1 |
| 2005/0181231 | A1 * | 8/2005 | Gupta et al. | 428/668 |

FOREIGN PATENT DOCUMENTS

| | | | |
|---|---|---|---|
| JP | 6-256926 | * | 9/1994 |
| JP | 2003-313652 | * | 11/2003 |
| JP | 2004-211628 | * | 7/2004 |

* cited by examiner

*Primary Examiner*—George R Koch, III
(74) *Attorney, Agent, or Firm*—Marcella R. Louke; William Scott Andes

(57) ABSTRACT

A method for forming a ceramic layer on the surface of a turbine component. This method comprises the following steps: (a) providing a turbine component having a surface; (b) providing at least one ceramic tape overlaying the component surface; and (c) manually pressing the at least one ceramic tape against the component surface at a temperature of from about 150° to about 700° F. (from about 66° to about 371° C.) so as to cause the at least one ceramic tape to adhere to the component surface.

23 Claims, 5 Drawing Sheets

METHOD OF FORMING CERAMIC LAYER

BACKGROUND OF THE INVENTION

This invention broadly relates to a method for forming at least one ceramic layer by manually pressing at least one ceramic tape, while heated, against the surface of a turbine component.

Components located in certain sections of gas turbine engines, such as the turbine, combustor, augmentor, exhaust nozzle, etc., are often thermally insulated with a ceramic layer in order to reduce their service temperatures, which allows the engine to operate more efficiently at higher temperatures. These ceramic layers, often referred to as thermal barrier coatings (TBCs), have low thermal conductivity, need to strongly adhere to the component, and need to remain adherent throughout many heating and cooling cycles.

Coating systems capable of satisfying the above requirements typically include a metallic bond coat layer that adheres the thermal-insulating ceramic layer to the metal substrate of the component. Metal oxides, such as zirconia, partially or fully stabilized with yttria, magnesia or other stabilizer metal oxides, have been used as the materials in this thermal-insulating ceramic layer. This ceramic layer is typically deposited by air plasma spraying (APS), low pressure plasma spraying (LPPS), or a physical vapor deposition (PVD) technique, such as electron beam physical vapor deposition (EB-PVD), to provide a strain-tolerant columnar grain structure. Bond coat layers are typically formed of an oxidation-resistant diffusion coating material such as a diffusion aluminide or platinum aluminide, or an oxidation-resistant overlay metal alloy material such as MCrAlY (where M is typically iron, cobalt, nickel, or a combination thereof). Aluminide coatings are distinguished from MCrAlY coatings, in that the former are intermetallic (diffusion) coatings, while the latter are metallic solid solution coatings.

While coating systems of the type described above are widely used, the requirement that the coating system remain adherent to the metal substrate surface through many heating and cooling cycles is particularly demanding because the coefficient of thermal expansion (CTE) of ceramic materials is usually significantly lower than that of the superalloy metals typically used as the substrate of turbine engine components. Such differences in CTE, in combination with oxidation of the underlying bond coat layer or metal substrate, can eventually lead to spallation and partial or complete loss of the coating system. See background section of commonly-assigned U.S. Pat. No. 6,485,590 (Ivkovich, Jr. et al), issued Nov. 26, 2002.

An additional desired characteristic for a coating system of a gas turbine engine component is for the outermost surface of the coating system to be extremely smooth in order to promote the aerodynamics of the component surface. While relatively smooth ceramic coatings can be produced by spraying or PVD techniques, smoother surface finishes would be desirable. In general, the techniques described above tend to produce ceramic coatings that are relatively porous, which is advantageous in achieving a lower coefficient of thermal conduction. See background section of commonly-assigned U.S. Pat. No. 6,485,590 (Ivkovich, Jr. et al), issued Nov. 26, 2002.

However, porosity in ceramic coatings can also promote surface roughness ($R_a$). For example, ceramic coatings deposited by PVD techniques generally have a surface roughness of about 60 microinches (about 1.5 micron) $R_a$ and higher. Those deposited by APS and LPPS techniques typically have an even higher surface roughness of from about 260 to about 400 microinches (from about 6.6 to about 10.2 microns) $R_a$. Ceramic coatings deposited by conventional spray methods on components with complex geometries (e.g., curved surfaces) are further prone to such surface flaws as shadowing effects (i.e., thin or beaded regions caused by partial masking due to component shape) and slumping (i.e., thicker regions formed by movement of material to low portions of a component due to gravity). See background section of commonly-assigned U.S. Pat. No. 6,485,590 (Ivkovich, Jr. et al), issued Nov. 26, 2002.

Accordingly, it would be desirable to be able to form one or more ceramic layers on the surface of gas turbine engine components that: (1) are adherent to the component surface through many heating and cooling cycles; and (2) can be denser and smoother for improved aerodynamic performance.

BRIEF DESCRIPTION OF THE INVENTION

An embodiment of this invention is broadly directed at a method comprising the following steps:

(a) providing a turbine component having a surface;

(b) providing at least one ceramic tape overlaying the component surface; and (c) manually pressing the at least one ceramic tape against the metal substrate surface at a temperature of from about 150° to about 700° F. (from about 65° to about 371° C.) so as to cause the at least one ceramic tape to adhere to the component surface.

The method of this invention provides a number of advantages and benefits with regard to forming thermal-insulating ceramic layers on the surface of turbine components. This method can be carried out using relatively available and inexpensive equipment. This method can also be more easily carried out at remote locations to apply a new ceramic layer, or repair a previously worn out and/or damaged ceramic layer on the surface of the turbine component. The ceramic tape can be formed to any desired shape of the surface of turbine component to which it is applied. The ceramic tape applied by this method also remains adherent to the surface of the turbine component until fired to sinter and fuse the ceramic material together to form the ceramic layer.

DETAILED DESCRIPTION OF THE INVENTION

Figure 1:
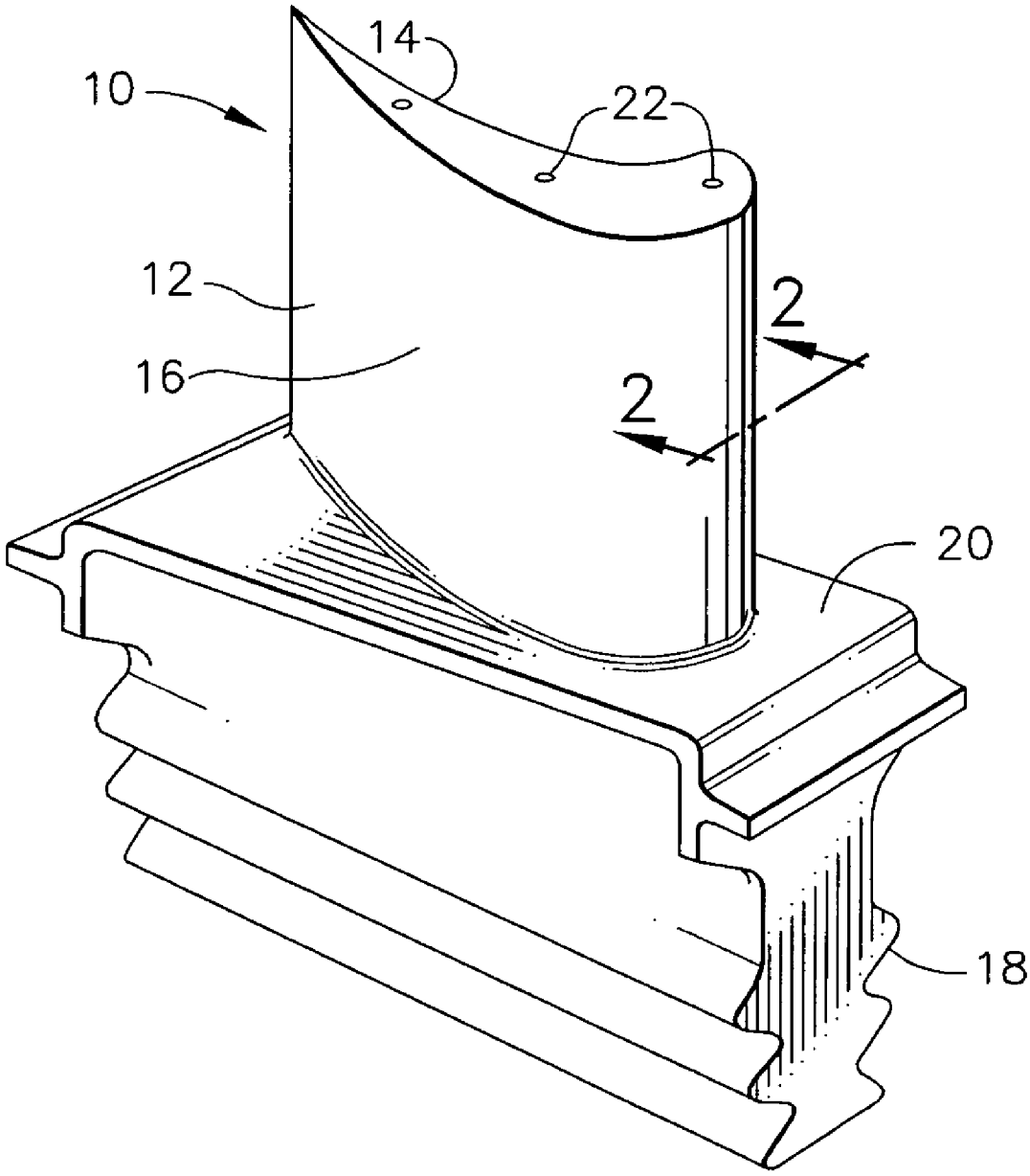
FIG. 1 is a perspective view of a turbine blade for which the method of this invention is useful.

As used herein, the terms "component surface" and "surface of the turbine component" can refer to the metal substrate surface, the surface of a bond coat layer overlaying and typically adjacent to the metal substrate, or the surface of a ceramic layer or ceramic tape overlaying and adjacent to another ceramic layer, the bond coat layer or the metal substrate, including a ceramic layer previously formed by an embodiment of the method of this invention. Typically, the terms "component surface" and "surface of the turbine component" refer to the surface of a bond coat layer, a ceramic layer or a ceramic tape.

As used herein, the term "ceramic tape" refers to a solid, malleable strip, sheet, portion of a sheet or strip (e.g., a square or rectangular portion formed from a strip or sheet), etc., that is typically formed from cast compositions that comprise a ceramic material, usually in the form of ceramic particles, dispersed in, mixed with or blended with, etc., a matrix that typically includes one or more binders that can be organic and/or inorganic, and/or one or more plasticizers. Organic binders typically impart flexibility and coherence to the ceramic tape at nominal room temperatures, while the inorganic binders typically form a ceramic matrix when the ceramic tape is fired to sinter and fuse the ceramic particles therein. Inorganic binders such as glass particles (e.g., glass frit) can function in the ceramic tape as binders (i.e., after firing of the ceramic tape as described hereafter), ceramic particles or both. The ceramic particles are typically homogeneously or substantially homogeneously dispersed, mixed, blended, etc., in or within this matrix. The binders and plasticizers in the matrix typically comprise the balance of the ceramic tape, and cause the ceramic particles to adhere together to yield ceramic tapes that typically can be manipulated and applied to irregular surfaces (e.g., curved surfaces). Suitable binders include a polyvinyl butyral available under the trade name B-79 from Monsanto Co., silicon polymers such as silicones available under the trade names SR355 and SR350 from the General Electric Company, alumanoxanes, sol-gels, etc. Suitable plasticizers include dibutyl phthalate (DBP), the aforementioned B-79 alone or in combination with DBP, etc. A sufficient fraction of binders and/or plasticizers is present to enable the ceramic tape to be applied and to be adhered to the intended component surface with the use of manual pressure and heat, as described hereafter. The particular composition of the ceramic tape can be varied in response to, for example, the properties desired for the resulting ceramic layer(s), the environment that the resulting ceramic layer(s) will be subjected to, the CTE characteristics of the component surface on which the ceramic layer(s) is formed, etc. To control the thermal expansion characteristics of the resulting ceramic layer(s), predetermined blends of certain ceramic materials can be used. For example, the binders and/or plasticizers can be selected and incorporated in higher amounts to create submicron voids in the ceramic layer during sintering and fusing, thus promoting a thermal insulating effect. By contrast, to provide thinner, more dense ceramic layers that can be processed to have a very smooth surface, for example with a surface roughness of about 20 microinches (about 0.5 microns) or less $R_a$, typically about 8 microinches (about 0.2 microns) or less $R_a$, and to minimize porosity (e.g., to about 10% or less), the ceramic tape typically comprises a lower fraction of organic materials, in particular, organic binders and/or plasticizers. See commonly assigned U.S. Pat. No. 6,465,090 (Stowell et al), issued Oct. 15, 2002; and U.S. Pat. No. 6,485,590 (Ivkovich et al), issued Nov. 26, 2002 (the relevant disclosures of which are incorporated by reference), for suitable ingredients, including ceramic particles, binders and plasticizers, that can be present in ceramic tapes useful herein. The ceramic tape is typically cast on a supporting structure, layer or matrix, for example, a non-ceramic carrier film, strip, sheet, or tape, such as a release paper, or a polymer tape or film, such as a Mylar film or polytetrafluoroethylene (e.g., Teflon) film. This polymer tape or film can be made from an anti-stick polymer so that the device (e.g., electric iron) heating the ceramic tape does not stick thereto, for example, a polytetrafluoroethylene (e.g., Teflon) film. Suitable ceramic tapes for use herein can be prepared by standard tape casting systems and processes, such as those disclosed in commonly assigned U.S. Pat. No. 6,465,090 (Stowell et al), issued Oct. 15, 2002, especially col. 8, lines 14-32; and U.S. Pat. No. 6,485,590 (Ivkovich et al), issued Nov. 26, 2002, especially col. 5, line 64 through col. 6, line 17, the relevant disclosures of which are incorporated by reference.

As used herein, the term "ceramic materials" refers to those materials typically used to form thermal barrier layers, and which have a melting point that is typically at least about 2600° F. (1426° C.), and more typically in the range of from about 3450° to about 4980° F. (from about 1900° to about 2750° C.). Suitable ceramic materials for use herein include aluminum oxide (alumina), i.e., those compounds and compositions comprising $Al_2O_3$, including unhydrated and hydrated forms, silica, various zirconias, in particular phase-stabilized zirconias (e.g., zirconia blended with various stabilizer metal oxides such as yttrium oxides), such as yttria-stabilized zirconias, ceria-stabilized zirconias, calcia-stabilized zirconias, scandia-stabilized zirconias, magnesia-stabilized zirconias, india-stabilized zirconias, ytterbia-stabilized zirconias, etc., as well as mixtures of such stabilized zirconias, etc. See, for example, Kirk-Othmer's Encyclopedia of Chemical Technology, 3rd Ed., Vol. 24, pp. 882-883 (1984) for a description of suitable zirconias. Suitable yttria-stabilized zirconias can comprise from about 1 to about 20% yttria (based on the combined weight of yttria and zirconia), and more typically from about 3 to about 10% yttria. Representative ceramic materials for incorporation into these ceramic tapes include alumina, zirconia, stabilized zirconias (e.g., yttria-stabilized zirconias), silica, as well as combinations thereof. Suitable alumina powders include A-14 (an unground calcined alumina powder; ultimate particle size of from about 2 to about 5 microns) and A-16SG (a super-ground thermally reactive alumina powder; ultimate particle size of from about 0.3 to about 0.5 microns), both available from ALCOA, and SM8 (ultimate particle size of about 0.15 microns) available from Baikowski International Corp. Silica can be provided in the form of glass particles (e.g., glass frit) which can function as a binder after firing, or can be formed in situ during firing of the ceramic tape from a source of silica such as a silicone, which can also function as a binder prior to firing. Suitable silicones include polymethyl siloxanes, for example, silicones manufactured under the name SR355 by the General Electric Company, also referred to as a methylsesquisiloxane mixture of the polysiloxane family. One or more of these ceramic materials can be included in the ceramic tapes used to form the ceramic layers. The inclusion of glass particles (e.g., glass frit) and other silicon-based materials is desirable from the standpoint of improving the erosion resistance of the ceramic layer that is formed. Suitable glass frits include those commercially available from Vitripak, Inc. under the name V212, as well as V55B and V213 glass frit, and 7052 glass frit available from Corning. V212 glass frit has been shown to be especially suitable for having a melting temperature and coefficient of thermal expansion that are compatible with the materials comprising the surface of the turbine components and in the operating environment within a gas turbine engine. The particle size of the ceramic materials can be varied, with suitable particle sizes being in the range from about 0.02 to about 150 microinches (from about 0.005 to about 4 microns). Coarser particles (e.g., A-14) promote strain tolerance in the resulting ceramic layer, while finer particles (e.g., A-16SG and SM8) promote density and surface smoothness in the ceramic layer.

As used herein, the term "particle" refers to a particulate, powder, flake, etc., that inherently exists in a relatively small form (e.g., a size of about 5 microns or less) or can be formed by, for example, grinding, shredding, fragmenting, pulverizing or otherwise subdividing a larger form of the material into a relatively small form.

As used herein, the term "manually pressing" refers to the application of pressure by a manual method, typically by application of the force of a human hand. In manually pressing, hand pressure is typically applied through a manual portable device to the ceramic tape and against the surface of the turbine component. Manual pressing typically involves applying pressure to the area where the ceramic tape is to be adhered to the component surface while the ceramic tape is being simultaneously heated.

As used herein, the term "heating" refers to heating the ceramic tape directly, indirectly (e.g., by heating the surface of the turbine component), or a combination thereof, by a device that provides a source of heat. Suitable devices for heating the ceramic tape and/or component surface include, for example, an electric iron, preheated (flat) iron, soldering iron, a combined heat gun and roller, contoured heated manual press, etc., or a combination of such devices. Typically, the heat source (e.g., electric or heated iron) is also used to manually press the area where the ceramic tape is to be adhered to the component surface.

As used herein, the term "CTE" refers to the coefficient of thermal expansion of a material, and is referred to herein in units of $10^{-6}$/° F. For example, alumina which has a coefficient of thermal expansion of about 4 to $5\times10^{-6}$/° F. at about 1200° F. (649° C.) would be referred to herein as having a CTE of about 4 to 5.

As used herein, the term "comprising" means various compositions, compounds, components, ingredients, coatings, substrates, layers, steps, etc., can be conjointly employed in this invention. Accordingly, the term "comprising" encompasses the more restrictive terms "consisting essentially of" and "consisting of."

All amounts, parts, ratios and percentages used herein are by weight unless otherwise specified.

This invention is based on the discovery that ceramic tapes can be applied and adhered to surfaces of turbine components without the use of elaborate and cumbersome equipment such as caul plates, autoclaves and vacuum bags. See, for example, commonly assigned U.S. Pat. No. 6,485,590 (Ivkovich, Jr. et al), issued Nov. 26, 1992. Ceramic tapes for repairing damaged ceramic layers are desirable because the ceramic tape can be formed to the desired shape of the portion of the ceramic layer to be repaired. Previously, however, it was believed that autoclaving and vacuum bagging was required to adhere the ceramic tape to the component surface. Vacuum bagging is time consuming and sometimes difficult to use with turbine components having a surface with complex (e.g., curved) shapes. Autoclaving requires specialized equipment that is typically unavailable at remote locations where repair of ceramic layers on turbine components is desired.

The method of this invention solve these problems by manually pressing the ceramic tape, while heated to an appropriate temperature, against the surface of the turbine component so that ceramic tape is adhered to the component surface. For example, the ceramic tape can be adhered against the component surface by manually applying pressure using a portable standard heated flat iron. The use of such portable heating devices for adhering the ceramic tape to the component surface enables ceramic layer repairs to be more easily carried out at remote locations. Once adhered to the component surface, this ceramic tape can then be fired to sinter and fuse the ceramic material together to form the ceramic layer on the component surface. Firing of the ceramic tape can occur as the result of a separate firing step, or more typically occurs as the result of the heat generated by the turbine engine during operation that causes the ceramic materials to sinter and fuse together into a ceramic layer.

The method of this invention is useful in applying ceramic layers to the component surfaces of a wide variety of turbine engine (e.g., gas turbine engine) parts and components operated at, or exposed to, high temperatures, especially higher temperatures that occur during normal engine operation. These turbine engine parts and components can include turbine airfoils such as turbine blades and vanes, turbine shrouds, turbine nozzles, combustor components such as liners, deflectors and their respective dome assemblies, augmentor hardware of gas turbine engines, e.g., liners, exhaust nozzles, including exhaust liners, exhaust flaps and exhaust seals (see, for example, commonly assigned U.S. Pat. No. 5,813,609 (Ellerhorst), issued Sep. 29, 1998), etc. While the following discussion of an embodiment of the method of this invention will be with reference to turbine blades and vanes, and especially the airfoil portions thereof, that comprise these blades and vanes, it should also be understood that the method of this invention can be useful with other turbine components (e.g., the liners, flaps and seals of exhaust nozzles) that require ceramic layers on the component surface for thermal protection.

The various embodiments of this invention are further illustrated by reference to the drawings as described hereafter. Referring to the drawings, FIG. 1 depicts a component article of a gas turbine engine such as a turbine blade or turbine vane, and in particular a turbine blade identified generally as 10. (Turbine vanes have a similar appearance with respect to the pertinent portions.) Blade 10 generally includes an airfoil 12 against which hot combustion gases are directed during operation of the gas turbine engine, and whose surfaces are therefore subjected to high temperature environments. Airfoil 12 has a "high-pressure side" indicated as 14 that is concavely shaped; and a suction side indicated as 16 that is convexly shaped and is sometimes known as the "low-pressure side" or "back side." In operation the hot combustion gas is directed against the high-pressure side 14. Blade 10 is anchored to a turbine disk (not shown) with a dovetail 18 formed on the root section 20 of blade 10. In some embodiments of blade 10, a number of internal passages extend through the interior of airfoil 12, ending in openings indicated as 22 in the surface of airfoil 12. During operation, a flow of cooling air is directed through the internal passages (not shown) to cool or reduce the temperature of airfoil 12.

Figure 2:
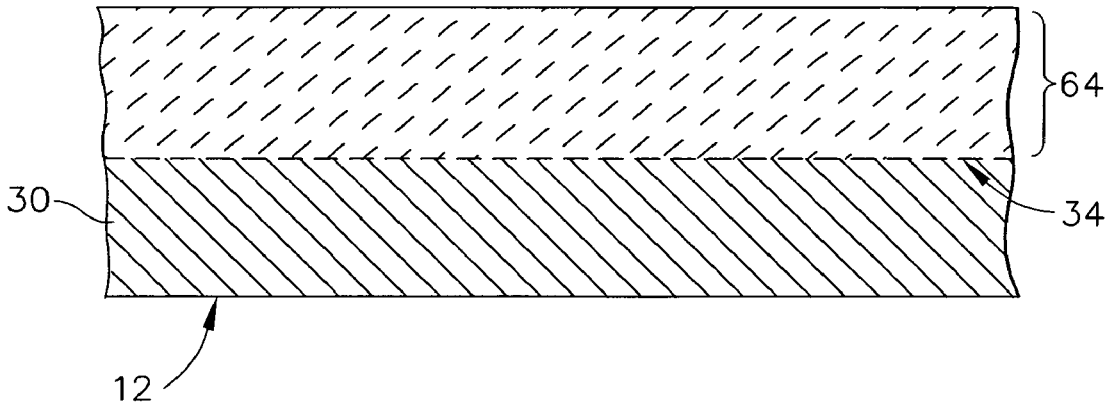
FIG. 2 is a sectional view of the blade of FIG. 1 showing an embodiment of the method of this invention for applying one ceramic tape on the surface of the turbine component.

Referring to FIG. 2, the base material of airfoil 12 is indicated generally as 30 and is shown as having a surface 34. Base material 30 can comprise a metal substrate, typically a bond coat layer overlaying and adjacent to the metal substrate, and optionally one or more ceramic layers overlaying the bond coat layer/metal substrate. Suitable metal substrates for base material 30 can comprise any of a variety of metals, or more typically metal alloys, including those based on nickel, cobalt and/or iron alloys. The metal substrate typically comprises a superalloy based on nickel, cobalt and/or iron. Such superalloys are disclosed in various references, such as, for example, commonly assigned U.S. Pat. No. 4,957,567 (Krueger et al), issued Sep. 18, 1990, and U.S. Pat. No. 6,521,175 (Mourer et al), issued Feb. 18, 2003, the relevant portions of which are incorporated by reference. Superalloys are also generally described in Kirk-Othmer's Encyclopedia of Chemical Technology, 3rd Ed., Vol. 12, pp. 417-479 (1980), and Vol. 15, pp. 787-800 (1981). Illustrative nickel-based superalloys are designated by the trade names Inconel®, Nimonic®, Rene® (e.g., Rene® N5, Rene® 88, Rene® 104 alloys), and Udimet®.

Suitable bond coat layers for base material 30 that can overlay the metal substrate are typically formed from a metallic oxidation-resistant material that protects the underlying metal substrate and enables subsequent overlaying ceramic layers, including ceramic layers formed by an embodiment of the method of this invention, to adhere more tenaciously to base material 30. Suitable materials for the bond coat layer include overlay bond coat materials having the formula MCr, MAl, MCrAl, MCrAlX, or MAlX, wherein M is nickel, cobalt, iron, etc., or an alloy thereof, and wherein X is hafnium, zirconium, yttrium, tantalum, platinum, palladium, rhenium, silicon, etc., or a combination thereof, such as MCrAlY alloys wherein M is nickel or a nickel-cobalt alloy and NiAl(Zr) alloys, as well as various noble metal diffusion aluminides such as platinum aluminide, as well as simple aluminides (i.e., those formed without noble metals) such as nickel aluminide.

As shown in FIG. 2, a ceramic tape 42 is applied to surface 34 of base material 30 by manually pressing tape 42 against surface 34 while being heated at a temperature in the range of from about 150° to about 700° F. (from about 66° to about 371° C.), typically from about 200° to about 450° F. (from about 93° to about 232° C.). Tape 42 can be heated to these temperatures directly, can be heated indirectly to these temperatures by heating base material 30, or a combination thereof. This manual application of pressure and heat is sufficient to cause tape 42 to adhere to surface 34.

In an embodiment of the method of this invention, tape 42 is manually pressed against surface 34 by the same device that heats tape 42 (e.g., by an electric or heated flat iron). A release cloth or other release material such as a sheet of silicone rubber is typically positioned between tape 42 and the device for applying the manual pressure/heat so that tape 42 does not stick to the device. With portable devices such as electric or heated flat irons, a motion similar to ironing clothes is typically used to manually apply the pressure to tape 42 against surface 34.

After application and adherence to surface 34, tape 42 is typically fired to sinter and fuse the ceramic material in tape 42 to form an adhered ceramic layer on surface 34. A suitable technique to fire tape 42 is to heat tape 42 at a rate of up to about 10° F. per minute (about 5.5° C. per minute) to a maximum hold temperature of from about 800° to about 2500° F. (from about 425° to about 1370° C.). This hold temperature is typically maintained for a period of at least about 1 hour to sinter and fuse the ceramic material in tape 42 to form the adhered ceramic layer on surface 34. The firing step can be carried out, for example, by the separate application of heat to the adhered tape 42, or as the result of the heat generated during operation of the turbine engine that causes the ceramic material in tape 42 to fuse and sinter together into the ceramic layer on surface 34.

Figure 3:
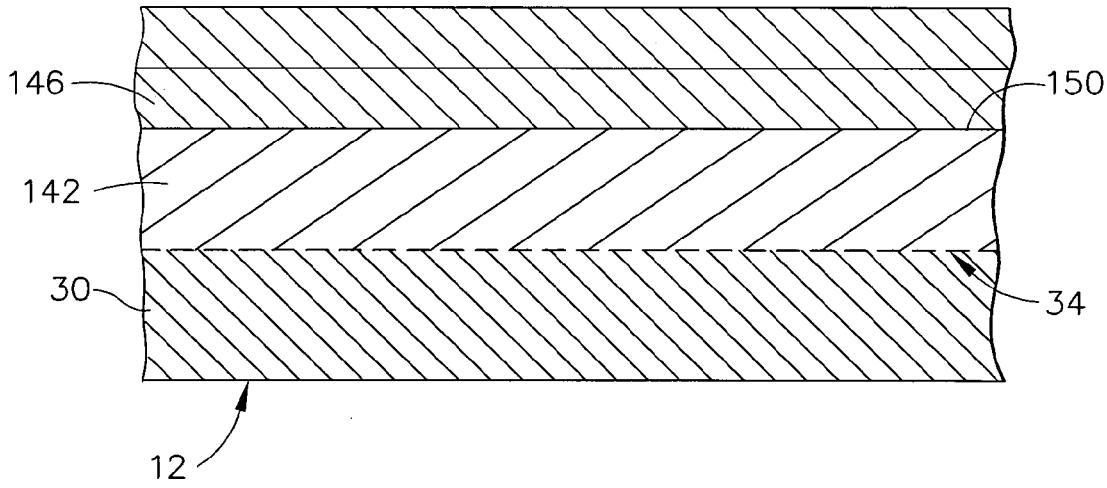
FIG. 3 is a sectional view of the blade of FIG. 1 showing an embodiment of the method of this invention for applying a plurality of ceramic tapes on the surface of the turbine component.

FIG. 3 shows an alternative embodiment of the method of this invention for applying a plurality of ceramic tapes indicated, for example, as inner tape 142 and outer tape 146. Inner tape 142 and outer tape 146 are typically applied as layers, with inner tape being applied to surface 34 and outer tape being applied to surface 150 of inner tape 146. Tapes 142 and 146 can comprise the same composition of ceramic and matrix materials, but more typically comprise different compositions. Tapes 142 and 146 can be applied together and manually pressed as a combination while being heated (i.e., using temperatures within the ranges previously defined in applying tape 42 to surface 34) against surface 34. More typically, inner tape 142 is applied and manually pressed separately while being heated (i.e., using temperatures within the ranges previously defined in applying tape 42 to surface 34) against surface 34 to adhere tape 142 to surface 142. Outer tape 146 is then subsequently applied and manually pressed while being heated (i.e., using temperatures with the ranges previously defined in applying tape 42 to surface 34) against surface 150 of inner tape 142. The applied combination of tapes 142 and 146 are typically fired (using the same or similar conditions for firing tape 42) to sinter and fuse the ceramic materials in the respective tapes to form, respectively, inner ceramic layer 142 and outer ceramic layer 146.

While the above embodiments of the method of this invention have been described in the context of turbine blades and vanes, the method of this invention can be also be used to apply ceramic tapes 42 or 142/146, as described above, to the component surfaces of various turbine components, including, for example, the liners, flaps and seals of exhaust nozzles. The ceramic tapes 42 or 142/146 can also be applied to the surface of the turbine component, as described above, during original manufacture of the turbine component (i.e., an OEM component), after the turbine component has been in operation for a period of time, after other ceramic layers have been removed from the turbine component (e.g., a repair situation), while the turbine component is in an assembled state or after the turbine component is disassembled, etc.

Figure 4:
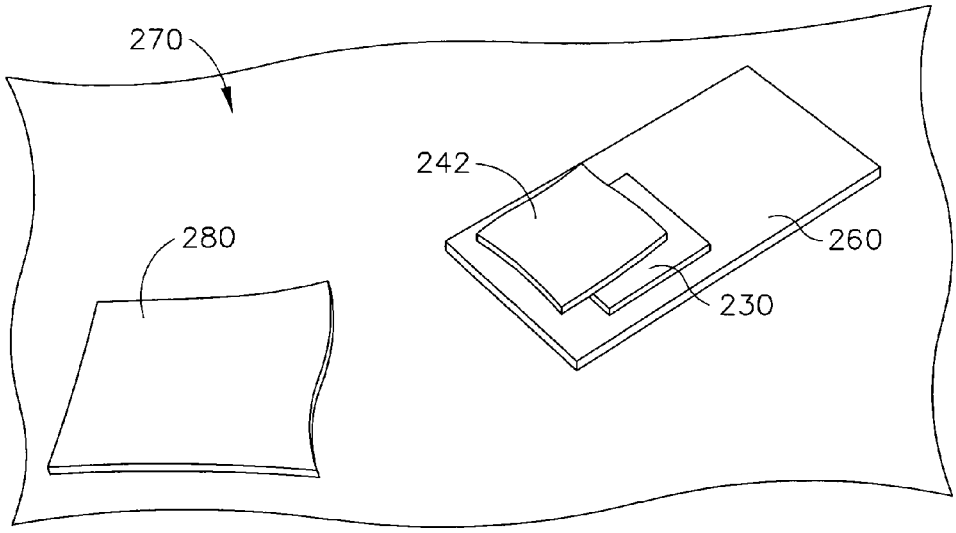
FIGS. 4-6 represent several views to illustrate an embodiment of the method of this invention for applying a ceramic tape to the surface of a ceramic layer of a coupon sample representing a turbine component.
Figure 5:
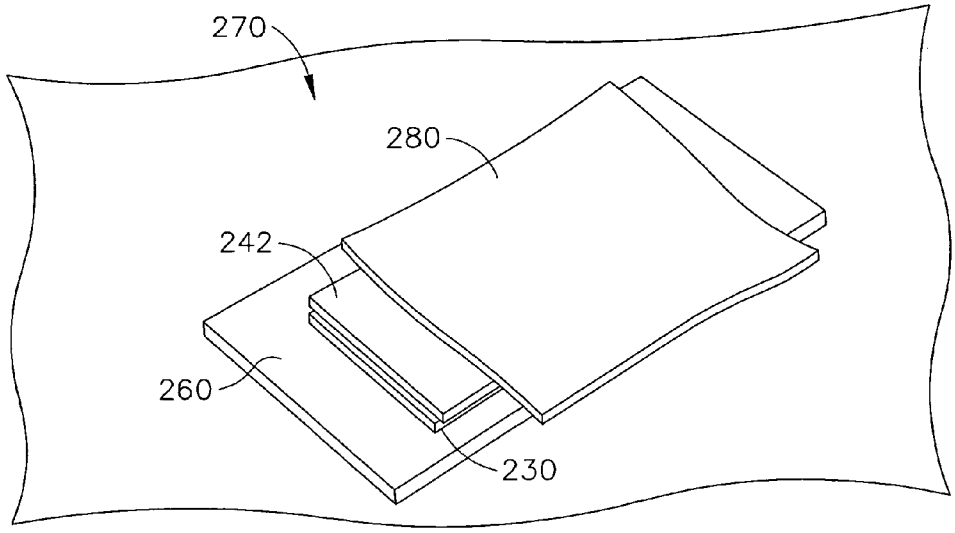
Figure 6:
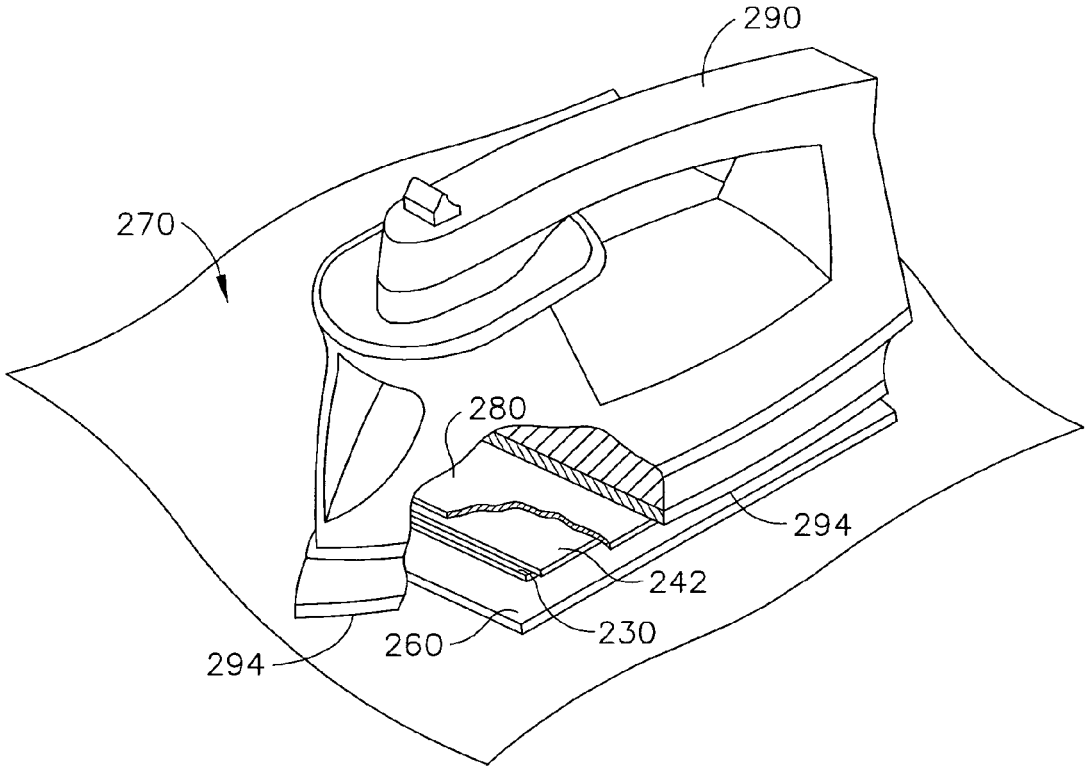

The following example illustrates an embodiment of the method of this invention for applying a ceramic tape to a coupon sample (representing a turbine component) using an electric or heated flat iron:

Referring to FIG. 4, a generally square-shaped coupon sample having an outer ceramic layer and indicated as 230, is placed on a first piece of silicone rubber sheet material indicated as 260 or similar protective material to protect table top 270 from being damaged by the electric or flat iron 290 having heating surface 294 (see FIG. 6). As shown in FIGS. 4 and 5, a portion of ceramic tape indicated as 242 having a similar size and shape as sample 230 is overlaid thereon. As shown in FIG. 5, a second piece of silicone rubber sheet material or other release material indicated as 280 is placed over tape 242 to keep the heating surface 284 from sticking to tape 242. Iron 290 is turned on (in the case of an electric iron), or heating surface 294 is heated (in the case of a flat iron), so that heating surface 294 becomes hot enough to cause tape 242 to adhere to the surface of sample 230. When hot enough, heating surface 294 of iron 290 is positioned on top of tape 242, as shown in FIG. 6. Iron 290 is moved back and forth over tape 242, using a typical ironing motion, while manual applying pressure against tape 242 so that tape 242 is squeezed against sample 230, thus causing adherence of tape 242 to sample 230.

While specific embodiments of the this invention have been described, it will be apparent to those skilled in the art that various modifications thereto can be made without departing from the spirit and scope of this invention as defined in the appended claims.

What is claimed is:

1. A method comprising the following steps:

(a) providing a turbine component having a surface;

(b) providing at least one ceramic tape overlaying the component surface; and (c) manually pressing the at least one ceramic tape against the component surface at a temperature of from about 150° to about 700° F. so as to cause the at least one ceramic tape to adhere to the component surface.

2. The method of claim 1 wherein the at least one ceramic tape is manually pressed and heated in step (c) by a portable device.

3. A method comprising the following steps:

(a) providing a turbine component having a surface;

(b) providing at least one ceramic tape overlaying the component surface; and (c) manually pressing the at least one ceramic tape against the component surface at a temperature of from about 150° to about 700° F. so as to cause the at least one ceramic tape to adhere to the component surface;

wherein the at least one ceramic tape provided in step (b) comprises ceramic particles within a matrix comprising one or more binders and/or one or more plasticizers;

wherein the ceramic particles comprise at least one of a yttria-stabilized zirconia and a source of silica comprising a glass frit.

4. The method of claim 3 which comprises the further step (d) of firing the adhered ceramic tape to form a ceramic layer on the component surface.

5. The method according to claim 4 wherein step (d) is carried out by heat generated during the operation of a turbine engine, or in the alternative, by heating the adhered ceramic tape at a rate of up to about 10° F. per minute to a maximum hold temperature of from about 800° to about 2500° F., and maintaining the maximum hold temperature for a period of at least about 1 hour.

6. The method of claim 3 wherein the component surface provided in step (a) is the surface of a bond coat layer.

7. The method of claim 3 wherein the component surface provided in step (a) is the surface of a ceramic layer.

8. A method comprising the following steps:

(a) providing a turbine component having a surface;

(b) providing at least one ceramic tape overlaying the component surface;

(c) manually pressing, with a portable device, the at least one ceramic tape against the component surface at a temperature of from about 150° to about 700° F. so as to cause the at least one ceramic tape to adhere to the component surface, wherein the portable device is an electric iron, a preheated iron, a soldering iron, a combined heat gun and roller, a contoured heated manual press, or a combination thereof.

9. The method of claim 8 wherein the at least one ceramic tape provided in step (b) comprises ceramic particles within a matrix comprising one or more binders and/or one or more plasticizers.

10. The method of claim 9 wherein the ceramic particles comprise alumina, zirconia, stabilized zirconias, silica, or combinations thereof.

11. The method of claim 10 wherein the ceramic particles comprise glass particles as a source of said silica.

12. The method of claim 9 wherein the matrix comprises one or more of polyvinyl butyral, silicones, and dibutyl phthalate.

13. The method of claim 8 which comprises the further step (d) of firing the adhered ceramic tape to form a ceramic layer on the component surface.

14. The method of claim 13 wherein step (d) is carried out by heat generated during the operation of a turbine engine.

15. The method of claim 8 wherein step (c) is carried out by manually pressing the at least one ceramic tape against the component surface at a temperature of from about 200° to about 450° F.

16. The method of claim 8 wherein the turbine component provided in step (a) is a turbine blade or vane.

17. The method of claim 8 wherein the turbine component provided in step (a) is an exhaust liner, exhaust flap or exhaust seal.

18. The method of claim 8 wherein the turbine component surface provided in step (a) comprises the surface of a bond coat layer.

19. The method of claim 8 wherein the component surface provided in step (a) comprises the surface of a ceramic layer.

20. The method according to claim 8 wherein step (c) is carried out by heating the at least one ceramic tape with the portable heating device to a temperature of from about 200° to about 450° F.

21. A method comprising the following steps:

(a) providing a turbine component having a surface;

(b) providing at least one ceramic tape overlaying the component surface;

(c) manually pressing the at least one ceramic tape against the component surface at a temperature of from about 150° to about 700° F. so as to cause the at least one ceramic tape to adhere to the component surface;

(d) firing the adhered ceramic tape to form a ceramic layer on the component surface by heating the adhered ceramic tape at a rate of up to about 10° F. per minute to a maximum hold temperature of from about 800° to about 2500° F., and maintaining the maximum hold temperature for a period of at least about 1 hour.

22. A method comprising the steps of:

(a) providing a turbine component having a surface;

(b) providing at least one tape overlaying the component surface, wherein the tape includes a binder comprising a silicone as a silica precursor;

(c) manually pressing, with a portable device, the at least one tape against the component surface at a temperature of from about 150° to about 700° F. so as to cause the at least one tape to adhere to the component surface, wherein the portable device is an electric iron, a preheated iron, a soldering iron, a combined heat gun and roller, a contoured heated manual press, or a combination thereof; and (d) firing the adhered tape to form silica in situ from the silicone to form a ceramic layer comprising silica on the component surface.

23. The method according to claim 22 wherein step (d) is carried out by heat generated during the operation of a turbine engine, or in the alternative, by heating the adhered tape at a rate of up to about 10° F. per minute to a maximum hold temperature of from about 800° to about 2500° F., and maintaining the maximum hold temperature for a period of at least about 1 hour.

* * * * *